US010845140B2

(12) United States Patent
Smith et al.

(10) Patent No.: US 10,845,140 B2
(45) Date of Patent: Nov. 24, 2020

(54) METHOD AND TOOL FOR ALIGNMENT OF A GAS BLOCK AND RIFLE BARREL

(71) Applicants: Loring Smith, Lakeland, FL (US); Benjamin Gray, Lakeland, FL (US)

(72) Inventors: Loring Smith, Lakeland, FL (US); Benjamin Gray, Lakeland, FL (US)

( * ) Notice: Subject to any disclaimer, the term of this patent is extended or adjusted under 35 U.S.C. 154(b) by 0 days.

(21) Appl. No.: 15/976,193

(22) Filed: May 10, 2018

(65) Prior Publication Data

US 2019/0346223 A1 Nov. 14, 2019

(51) Int. Cl.
*F41A 5/26* (2006.01)
*F41A 35/00* (2006.01)
*F41A 21/28* (2006.01)

(52) U.S. Cl.
CPC ..... *F41A 5/26* (2013.01); *F41A 21/28* (2013.01); *F41A 35/00* (2013.01)

(58) Field of Classification Search
CPC .. F41A 5/26; F41A 21/28; F41A 35/00; F41A 21/30; F41A 5/18; F41A 5/28
USPC ..... 89/193; 42/90, 108
See application file for complete search history.

(56) References Cited

U.S. PATENT DOCUMENTS 2,732,769 A * 1/1956 Simpson ..... F41A 21/487 89/191.01
5,233,124 A * 8/1993 Peterson ..... F42B 35/02 33/506
5,737,866 A * 4/1998 Minaire ..... F41C 27/00 42/105
5,945,626 A * 8/1999 Robbins ..... F41A 5/26 42/111
6,032,398 A * 3/2000 Carpenteri ..... F41A 35/00 42/79
6,318,230 B1 * 11/2001 Bamber ..... F41A 21/26 42/77
6,526,686 B1 * 3/2003 Poff, Jr. ..... F41A 19/62 42/84
7,921,760 B2 * 4/2011 Tankersley ..... F41A 5/26 89/191.01
8,596,185 B1 * 12/2013 Soong ..... F41A 5/28 89/193
8,701,543 B2 * 4/2014 Brinkmeyer ..... F41A 21/30 89/191.01
8,960,069 B1 * 2/2015 Soong ..... F41A 5/28 89/193

(Continued)

*Primary Examiner* — Michelle Clement

(57) ABSTRACT

Method and tool for promptly aligning the mating port of a gas block with the gas port of a rifle barrel. The prompt alignment of the mating port and gas port is accomplished by using an alignment tool have an alignment port and an alignment slot. The alignment tool is inserted into the gas block such that the alignment port is centered over the mating port and that a portion of the alignment tool protrudes from the gas block. The top surface of the alignment tool is marked circumferentially and the forward end of the gas block is marked perpendicular to the alignment slot. The alignment tool is then removed from the gas block and affixed to the rifle barrel such that the alignment port is centered over the gas port. The barrel is marked through the alignment slot in line with the circumferential marking on the top surface of the alignment tool. The alignment tool is removed and the barrel inserted through the gas block until the marking on the forward end of the gas block is aligned with the marking on the barrel.

2 Claims, 7 Drawing Sheets

(56) References Cited

U.S. PATENT DOCUMENTS 9,273,916 B1* 3/2016 Russo ..... F41A 5/26
9,869,521 B1* 1/2018 Huang ..... F41A 5/18
2007/0033851 A1* 2/2007 Hochstrate ..... F41A 5/18 42/75.01
2010/0224056 A1* 9/2010 Monroe ..... F41A 3/62 89/193
2010/0282066 A1* 11/2010 Tankersley ..... F41A 5/26 89/193
2011/0023699 A1* 2/2011 Barrett ..... F41A 5/28 89/193
2011/0179945 A1* 7/2011 Clark ..... F41A 5/18 89/193
2013/0036648 A1* 2/2013 Shipman ..... F41C 23/16 42/108
2013/0047483 A1* 2/2013 Horne ..... F41C 27/00 42/90
2013/0055883 A1* 3/2013 Cassels ..... F41A 5/28 89/193
2013/0098235 A1* 4/2013 Reinken ..... F41A 5/28 89/193
2013/0185979 A1* 7/2013 Fridley ..... F41C 27/00 42/90
2013/0192118 A1* 8/2013 Shipman ..... F41C 27/00 42/108
2014/0060312 A1* 3/2014 Ruck ..... F41A 5/28 89/193
2014/0076150 A1* 3/2014 Brinkmeyer ..... F41A 5/28 89/193
2014/0190344 A1* 7/2014 Kenney ..... F41A 5/28 89/193
2014/0290112 A1* 10/2014 Horne ..... A61M 37/0076 42/90
2015/0266168 A1* 9/2015 Geissele ..... B25B 13/48 29/525.11
2016/0178299 A1* 6/2016 Cassels ..... F41A 5/28 89/193
2017/0336159 A1* 11/2017 Kitchen ..... F41A 5/26

* cited by examiner

METHOD AND TOOL FOR ALIGNMENT OF A GAS BLOCK AND RIFLE BARREL

CROSS-REFERENCES TO RELATED APPLICATIONS

Not Applicable.

STATEMENT REGARDING FEDERALLY SPONSORED RESEARCH

Not Applicable.

NAMES OF PARTIES TO JOINT RESEARCH AGREEMENT

Not Applicable

REFERENCE TO A SEQUENCE LISTING

Not Applicable.

BACKGROUND OF THE INVENTION

(1) Field of Invention

The present invention relates generally to gas-powered rifles and, more particularly, to a universal apparatus and method for axially and longitudinally aligning a gas block with the gas port of a gas-powered rifle. When a gas-powered rifle is fired, gas travels behind the bullet as the bullet travels down the barrel. A gas-powered rifle's barrel has a gas port that allows the hot gas traveling behind the bullet to pass out of the barrel and into a gas block, which directs the gas into the bolt carrier, causing it to cycle. The gas block has a hole or mating port that aligns with the rifle's gas port to allow the passage of the gas into the gas block and to the bolt carrier. A problem with the operation of the rifle can arise when the mating port of the gas block is not optimally aligned, axially and longitudinally, with the gas port. It is a very difficult to axially and longitudinally align the mating port of a gas block with a rifle's gas port, especially considering that civilian/commercial rifles are not standardized, and firearm manufacturers design several variants of gas-powered rifles and gas blocks. Generally, the alignment is achieved via a lengthy and frustrating process of trial and error, or by methods limited to use with a particular rifle or gas block.

(2) Background of Invention

There are a few methods and devices for aligning the gas port of a barrel with the mating port of a gas block during installation. An example of such a device is shown in U.S. Pat. No. 7,921,760, which discloses an installation device that utilizes a drill bit and undisclosed drilling machine to create a conical cavity in the barrel opposite the gas port. However, this device is limited to aligning the disclosed adjustable gas block by inserting a screw in the disclosed gas block into the cavity created by the drill bit. While this installation device fulfills its particular purpose, its application is very limited given the wide array of commercial gas blocks and gas-powered rifles that are manufactured. The method disclosed in U.S. Pat. No. 8,596,185 is similarly restricted to a particular purpose. The method of aligning a gas block disclosed in U.S. Pat. No. 8,596,185 is limited to those instances where the mating port extends through the gas block, allowing the insertion of a pin through the gas block and into the gas port for alignment. The hole is then closed off by the use of a détente pin already installed on the gas block itself.

U.S. patent application Ser. No. 11/009,344 discloses four methods of aligning a gas block mating port and gas port, all of which rely on inserting objects into a hole or recess in the rifle barrel. Specifically, the application of the invention disclosed in U.S. patent application Ser. No. 11/009,344 relies on either an alignment hole or key slot opposite the gas port, or aligned recesses on the side of the barrel. Such applications are similarly limited given the requirement that a barrel possess one of these components.

SUMMARY OF INVENTION

Accordingly, it remained for the present inventors to provide a universal method and tool for promptly and optimally aligning the gas port of a rifle barrel with the mating port of a gas block that would work with a wide variety of gas-powered rifle barrels and gas blocks. A preferred embodiment of the invention utilizes an alignment tool having an alignment port for longitudinally aligning the mating port and gas port, and an alignment slot for axially aligning the mating port and gas port. The alignment port is used to mark the distance from the mating port to the forward end of gas block and transfer that marking to the barrel to ensure that the forward end of the gas block is inserted over the barrel such that the distance from the forward end of the gas block to the gas port is the equivalent to the distance from the forward and of the gas block to the mating port. The alignment slot is used to mark the forward end of the gas block while the alignment port is centered over the mating port, and align that mark with the mark made on the barrel to ensure the axial alignment of the mating port and gas port.

DETAILED DESCRIPTION

Figure 1:
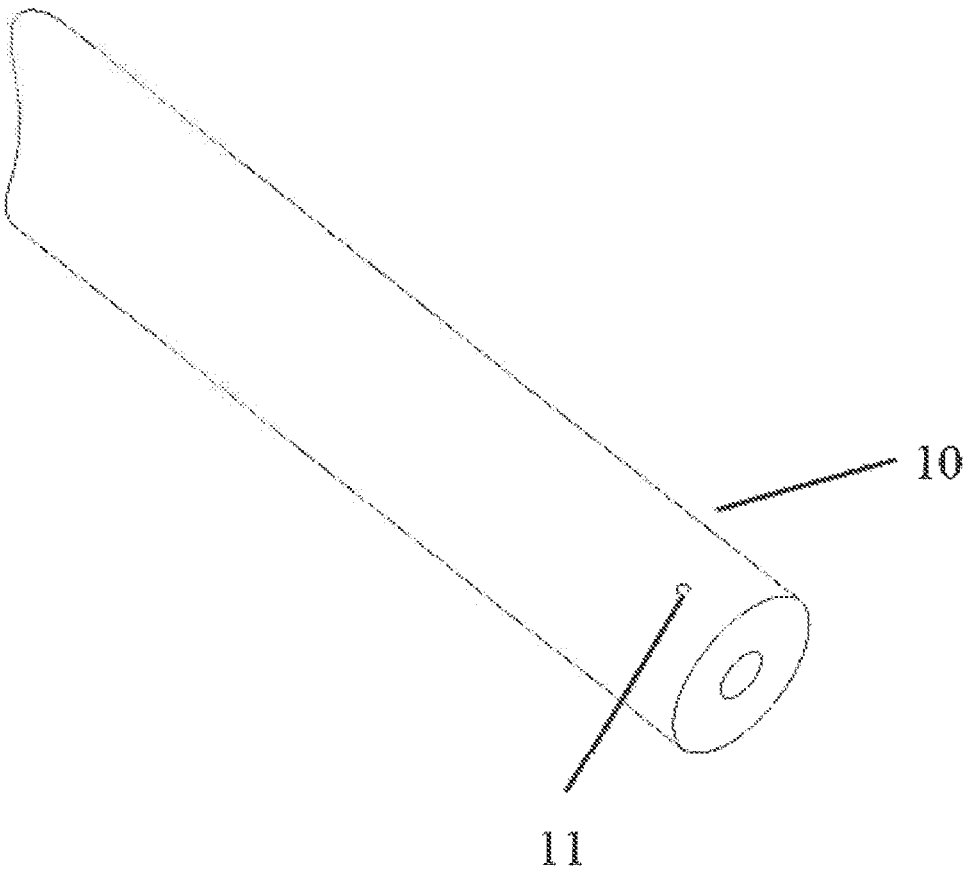
FIG. 1 is a perspective view of a rifle barrel with gas port.
Figure 2:
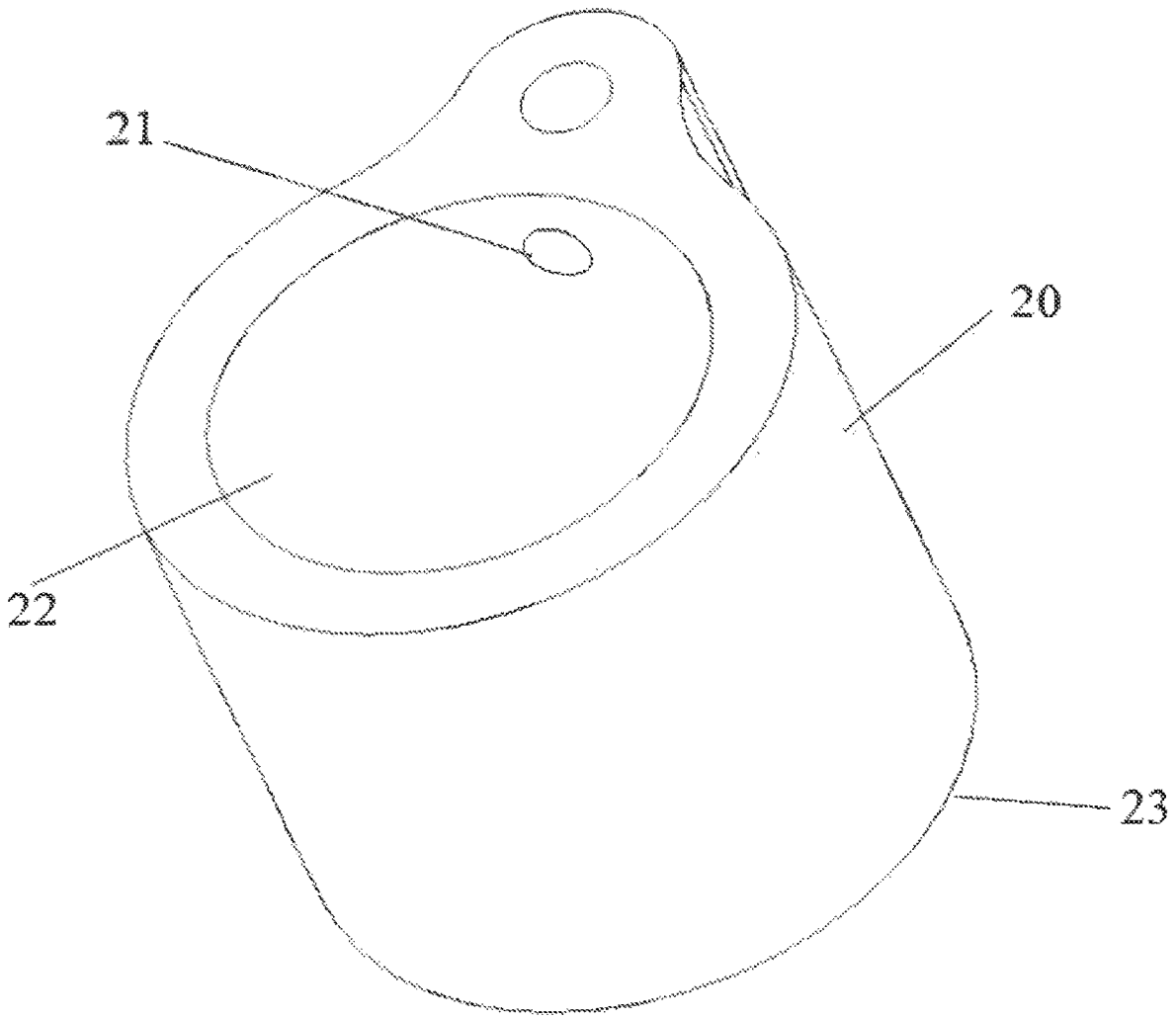
FIG. 2 is a perspective view of a gas block with mating port.
Figure 3A:
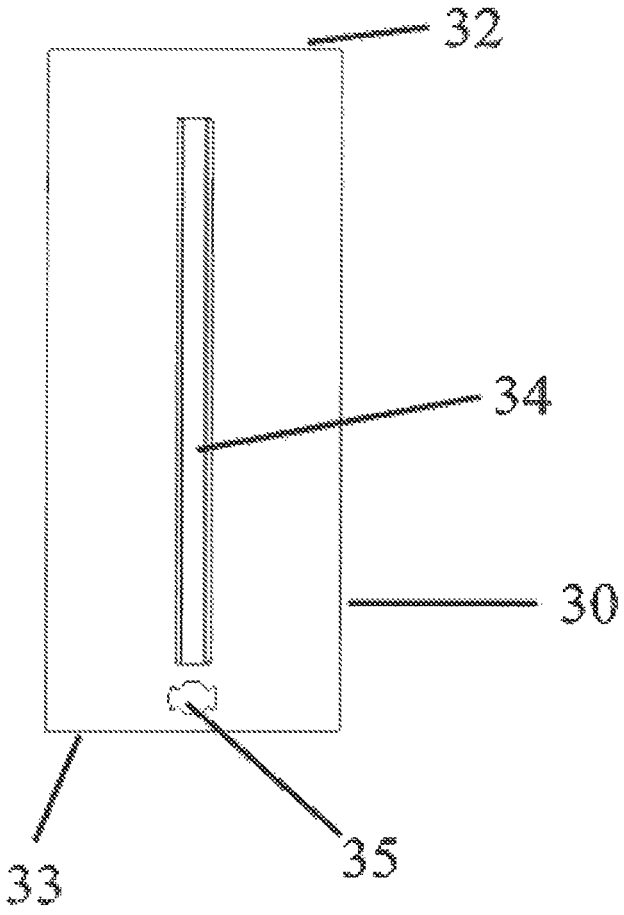
FIG. 3*a* is a top view of an alignment tool.
Figure 3B:
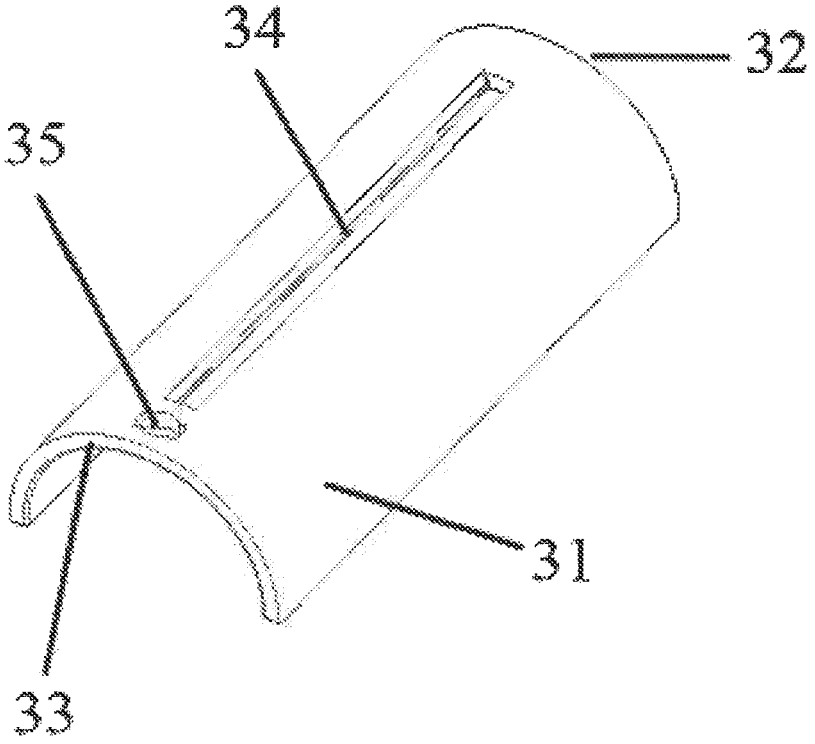
FIG. 3*b* is perspective view of an alignment tool.

In accordance with the present invention, FIG. 1 illustrates a cylindrical rifle barrel 10 with a gas port 11, and FIG. 2 illustrates a gas block 20 with a mating port 21. The gas block 20 contains a bore 22 to allow the rifle barrel 10 to be inserted through the gas block 20 so that gas port 11 and mating port 21 may be aligned. FIG. 3*a* and FIG. 3*b* illustrate an exemplary alignment tool 30 of suitable material for quickly and properly aligning the gas port 11 with the mating port 21. The alignment tool 30 is comprised of an elongated, semi-cylindrical member 31 having a forward and 32 and rear end 33, an alignment slot 34 running longitudinally through the greater part of the semi-cylindrical member 31, and an alignment port 35 located near the rear end 33 of the semi-cylindrical member 31. In this particular embodiment, the alignment slot 34 is beveled; however, the present invention may be accomplished with a tool having an alignment slot that is not beveled. Additionally, the semi cylindrical member 31 is of a diameter comparable to the diameter of the rifle barrel 10.

Figure 4:
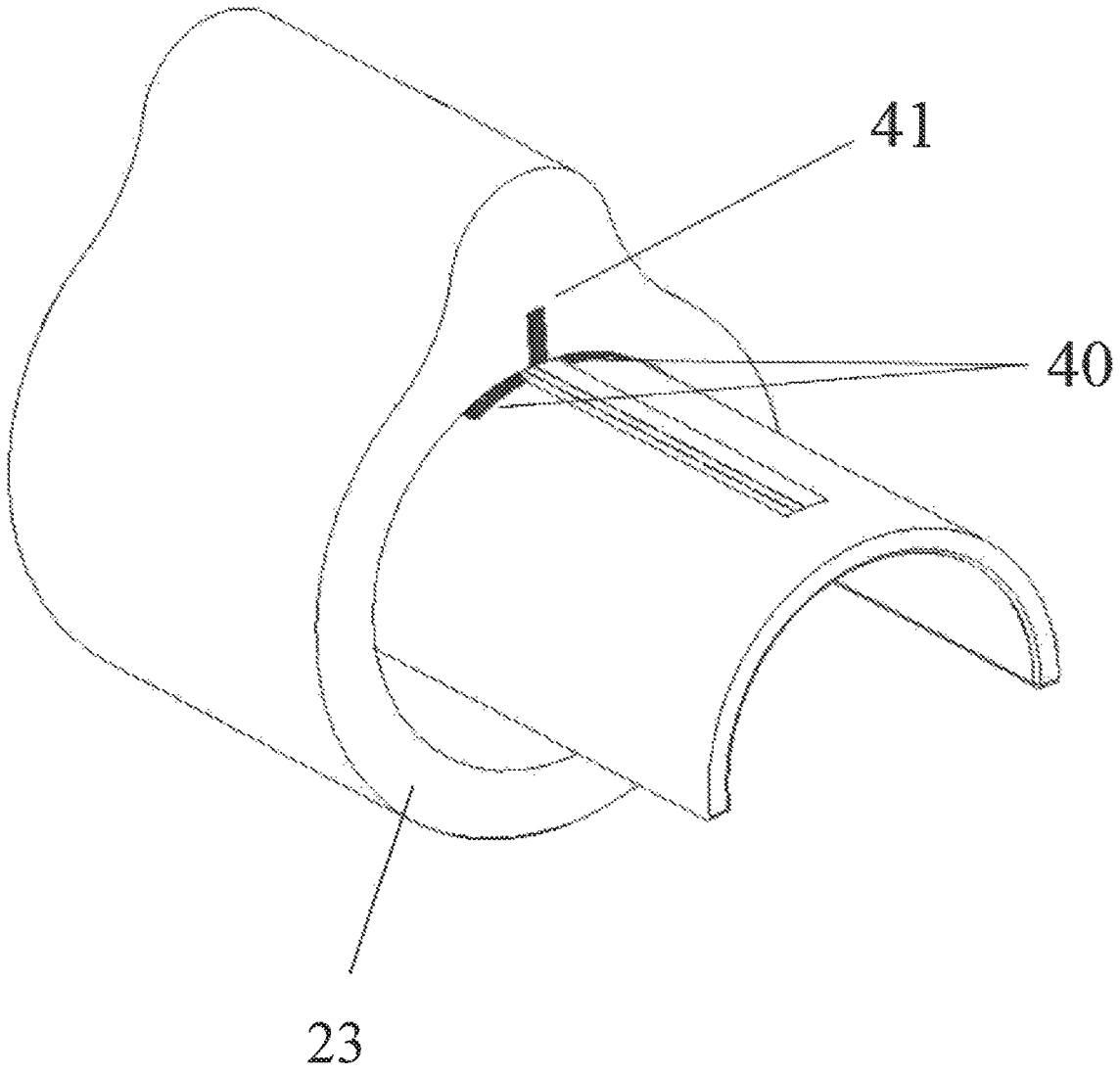
FIG. 4 is a perspective view showing an alignment tool inserted into a gas block with markings.
Figure 5:
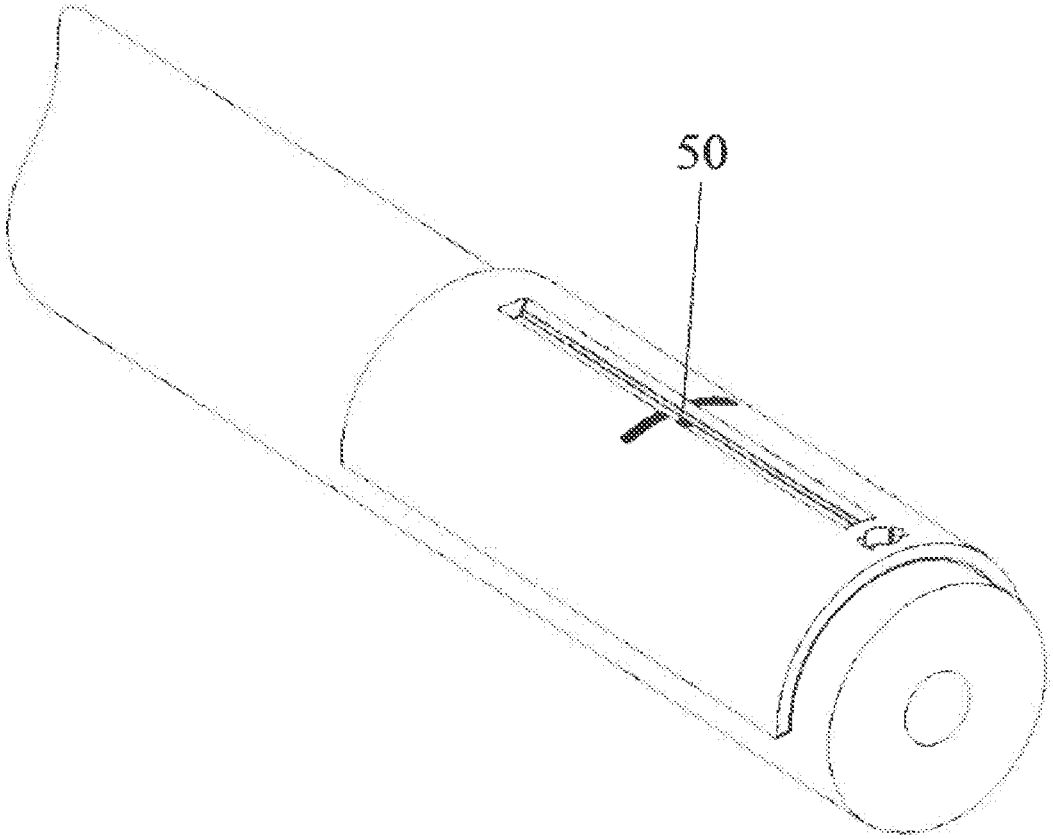
FIG. 5 is a perspective view showing an alignment tool affixed to a rifle barrel with markings.
Figure 6:
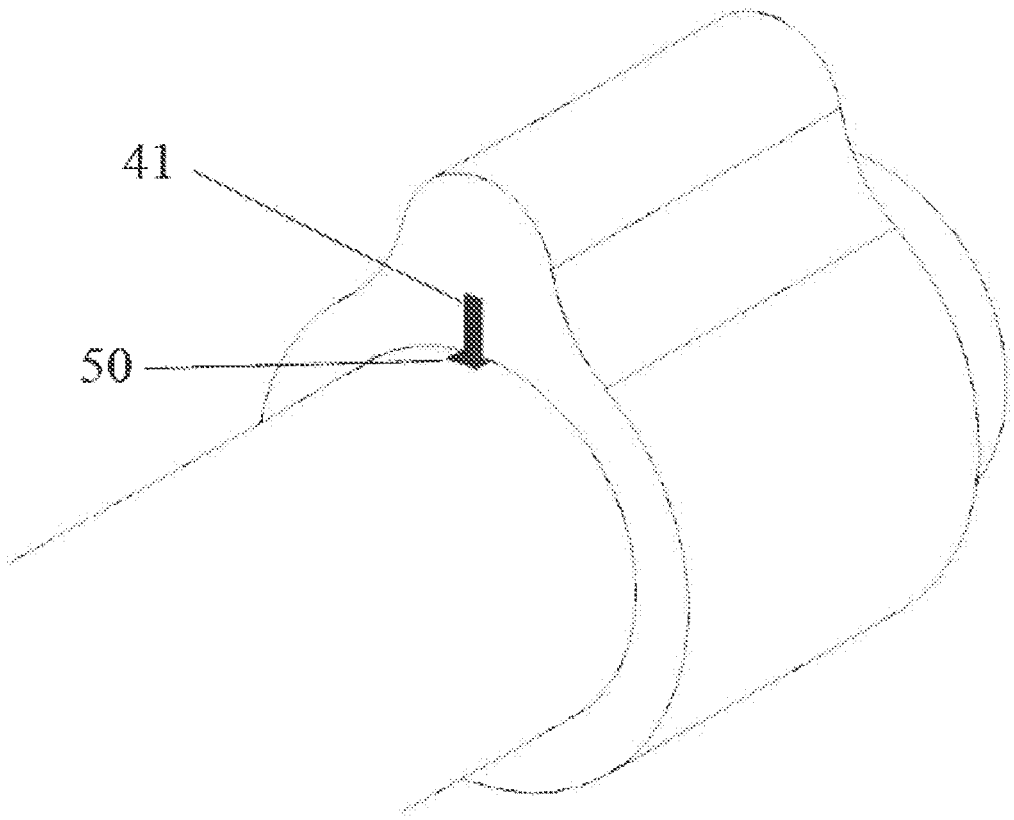
FIG. 6 is a perspective view showing a gas block installed over a rifle barrel with markings aligned.

FIG. 4, FIG. 5 and FIG. 6. illustrate an exemplary method of axially and longitudinally aligning the gas port 11 with the mating port 21 to obtain optimal performance of a gas-powered rile that incorporates the alignment tool 30. The rear end 33 of the alignment tool 30 is inserted through the bore 21 of the gas block 20 until the alignment port 35 is centered over the mating port 21. A portion of the alignment tool 30 will remain protruding from the gas block 20. It is an important feature of the invention that the alignment slot 34 be long enough to ensure that a portion of the alignment slot 34 is protruding from the bore 21 when the alignment port 35 is cantered over the mating port 21. While the alignment port 35 is centered over the mating port 21, a circumferential marking 40 is made on the top surface of the alignment tool 30 using a marking device such as a pen or marker where the forward end 23 of the gas block 20 meets the alignment tool 30. A second marking 41 is made on the forward end 23 of the gas block 20 perpendicular to the alignment slot 34.

The alignment tool 30 is then removed from the gas block 20 and affixed over the barrel 10 such that the alignment port 35 is centered over the gas port 11. The surface of the barrel 10 is marked 50 through the alignment slot 34 in line with the circumferential marking 40 on the alignment tool 30 using a marking device such as a pen or marker. The alignment tool 30 is then removed from the barrel 10. The barrel 10 is then inserted through the bore 22 of the gas block 20 until the mark on the barrel 10 is aligned with the mark on the forward end of the gas block 24, thus aligning the gas port 11 with the mating port 21.

The foregoing merely describes the present invention in an illustrative manner. The terminology employed is intended to be merely words of description, and not of limitation. It will thus be appreciated that that those skilled in the art will be able to make numerous modification and variations of the present invention in light of the above teachings. Such modifications and variations, while not illustrated or described herein, embody the principles of the present invention, and are within the spirit and scope of the appended claims.

The present inventor claims:

1. A method for aligning the gas port of a rifle barrel with a gas block, said gas block having a forward end and rear end, a bore, and a mating port within the bore, comprising:

inserting an alignment tool having an alignment port and alignment slot into the bore and centering the alignment port over the mating port;

marking the top surface of the alignment tool where the forward end of the gas block meets the alignment tool;

marking the forward end of gas block perpendicular to the alignment slot;

removing the alignment tool from the gas block;

affixing the alignment tool to the barrel and centering the alignment port over the gas port;

marking the surface of the barrel through the alignment slot in line with the marking on the alignment tool and removing the alignment tool from the barrel;

inserting the barrel through the bore of the gas block; and aligning the marking on the forward end of the gas block with the marking on the barrel.

2. A method for aligning the gas port of a rifle barrel with a gas block, said gas block having a forward end and rear end, a bore, and a mating port within the bore, comprising:

inserting a semi-cylindrical alignment tool of a diameter less than the diameter of the bore and equal to the diameter of the barrel, said alignment tool having an alignment port of a diameter equal to the diameter of the gas port and an alignment slot running longitudinally through the center of the alignment tool, into the bore and centering the alignment port over the mating port;

circumferentially marking the top surface of the alignment tool where the forward end of the gas block meets the alignment tool;

marking the forward end of the gas block perpendicular to the alignment slot;

removing the alignment tool from the gas block;

affixing the alignment tool to the barrel and centering the alignment port over the gas port;

marking the surface of the barrel through the alignment slot in line with the marking on the alignment tool and removing the alignment tool from the barrel;

inserting the barrel through the bore of the gas block; and aligning the marking on the forward end of the gas block with the marking on the barrel.

* * * * *